United States Patent [19]

Bühler

[11] 3,952,119

[45] Apr. 20, 1976

[54] PROCESS FOR COLORING ABSORPTIVE, ROUGH SURFACE PAPER

[75] Inventor: Helmut Bühler, Essen, Germany

[73] Assignee: Th. Goldschmidt AG, Germany

[22] Filed: Sept. 25, 1974

[21] Appl. No.: 509,114

Related U.S. Application Data

[63] Continuation of Ser. No. 376,525, July 5, 1973, abandoned.

[30] Foreign Application Priority Data

July 12, 1972 Germany ..... 2234205

[52] U.S. Cl. ..... 427/382; 101/170; 101/211; 101/426; 118/224; 427/288; 427/428

[51] Int. Cl.[2] ..... B41M 1/10; B41M 1/18

[58] Field of Search ..... 101/170, 211, 129, 426; 118/224; 427/288, 382, 428

[56] References Cited

UNITED STATES PATENTS

| | | | |
|---|---|---|---|
| 1,375,126 | 4/1921 | Willwerscheid | 118/224 |
| 1,379,365 | 5/1921 | Schultz et al. | 101/137 |
| 2,273,740 | 2/1942 | Terry | 101/211 X |
| 2,642,030 | 6/1953 | Brink | 118/249 X |
| 3,442,742 | 5/1969 | Jorgensen | 156/230 X |
| 3,470,054 | 9/1969 | Tyrrell | 101/170 |
| 3,693,585 | 9/1972 | Reeve et al. | 118/224 |

FOREIGN PATENTS OR APPLICATIONS

| | | | |
|---|---|---|---|
| 1,204,747 | 8/1959 | France | 101/123 |

*Primary Examiner*—Clyde I. Coughenour
*Attorney, Agent, or Firm*—James E. Bryan

[57] ABSTRACT

A method for coloring, dyeing-in or inking absorptive, rough surface paper, particularly paper which is subsequently saturated and/or impregnated with a solution of a heat-hardenable synthetic resin and then dried and pressed on a substrate, such as, wood panels, with as thin as possible a layer of coloring agent having an optically uniform coloring, in which the paper is colored by applying a magnetic roller coloring process thereto and, before or after such coloring, the paper is printed by a copperplate intaglio printing process or a flexographic (flexo-relief) printing process.

6 Claims, 1 Drawing Figure

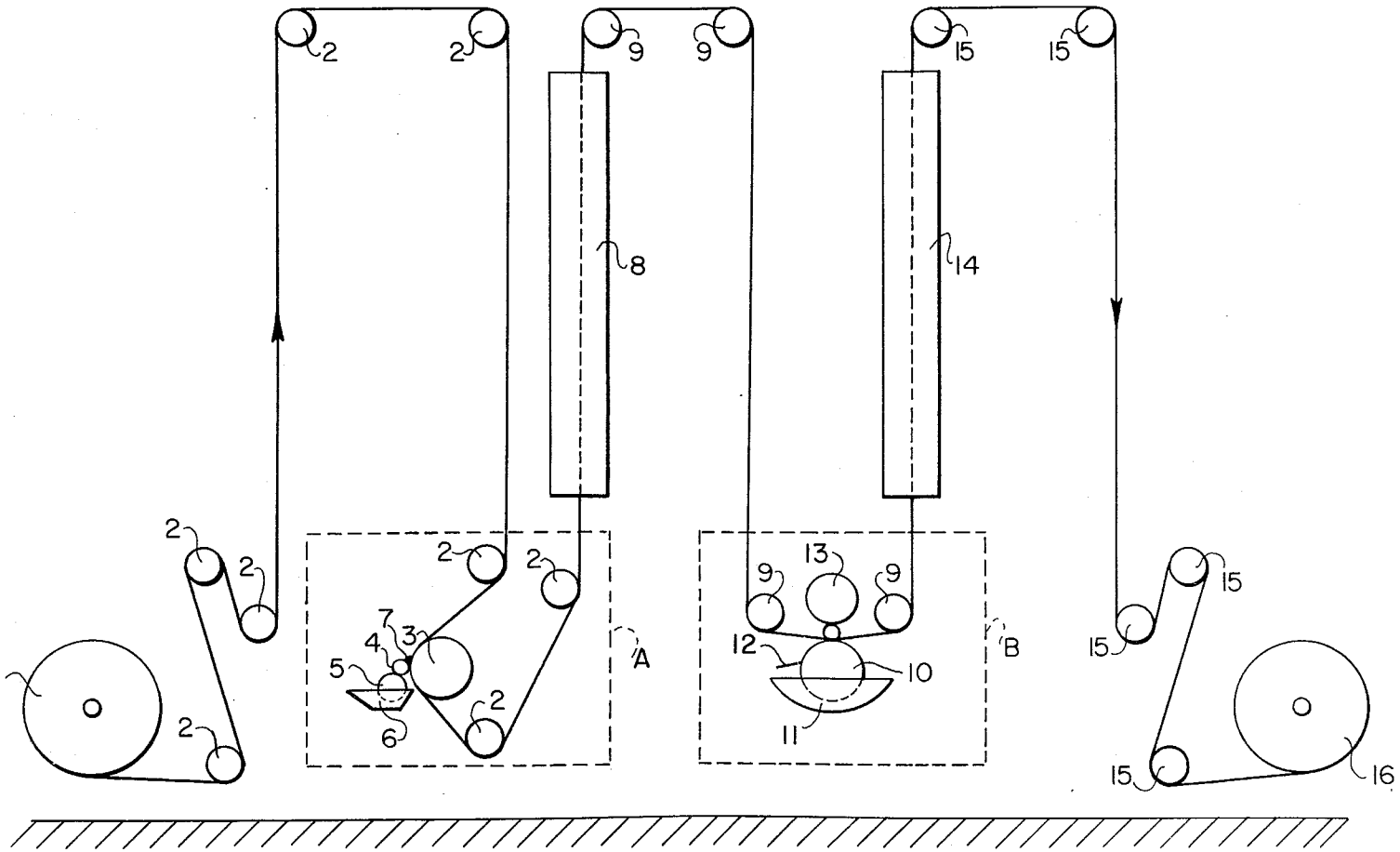
2
2
2
2
2
2
2
2
3
4
5
6
7
A
8
9
9
9
9
10
11
12
13
B
14
15
15
15
15
15
16

PROCESS FOR COLORING ABSORPTIVE, ROUGH SURFACE PAPER

This is a continuation of application Ser. No. 376,525, filed July 5, 1973, now abandoned.

The present invention relates to a process for coloring absorptive paper having a rough surface with a coloring agent having a thickness as small as possible, but having an optically uniform coloring, particularly for coloring papers which are impregnated and/or coated with heat-hardenable synthetic resin solutions.

In order to produce white and colored papers having the greatest possible uniformity, it is customary to dye-in, or color, these papers in the mass, i.e., during the manufacture thereof in a paper machine, by adding pigments to the fiber slurry. This presupposes, however, that, for reasons of economy, relatively large quantities of a particular paper is to be prepared in the same color tone.

In past years, a process for the surface treatment of sheets or panels of wood materials has found widespread use. In this process, papers are impregnated with a solution of a heat-hardenable synthetic resin, for example, a phenol or melamine and/or urea formaldehyde resin in which the resin components may be present in admixture, coated, if necessary, then dried, and subsequently pressed at elevated temperatures and under pressure onto the surfaces of sheets or panels of wood material, for example, wood chip sheets.

Employed as a carrier web for the impregnation is not only plain white and solid-color paper, but also white or colored base paper which is embossed with a decoration, for example, wood imitations. For reasons having to do with manufacturing techniques as well as for economical reasons, it is becoming progressively more difficult to obtain from paper factories relatively small quantities of solid-color paper, since, in the sale of these small amounts, the manufacturing costs of the paper rise beyond proportion.

Therefore, there exists, specifically for the manufacture of papers which are to be impregnated with hardenable synthetic resins, a need for developing a process which makes it possible to color or dye-in the grain, or to re-dye, both white and colored papers in such a manner that an optically uniform coloring is achieved with a uniform layer of as small a thickness as possible of the dyeing agent, such as is obtained in papers colored or dyed in the mass. A solution to this problem has not been known heretofore.

While it is possible to uniformly color or dye papers by means of rotational screen printing, the decisive disadvantage of this process is that, during the screen printing, relatively large amounts of printing ink are applied to the paper so that, due to the heavy application of coloring agent, the porosity and the absorptive capacity of the paper are greatly reduced. This renders the subsequent impregnation of the paper with synthetic resin solutions difficult, or even completely impossible.

It is true that other rotary printing processes, such as, relief printing and intaglio printing processes, transmit only small amounts of printing ink to the paper and, therefore, alter the paper's properties, which are important in the saturation or impregnation, only to a negligible extent. However, they do not permit printing over or on papers in an optically uniform manner, particularly when the papers have a certain degree of surface roughness.

In copper-plate intaglio printing and, analogously in flexo-relief printing (also called flexographic printing), it has been found that the more elevated, or more protruding fiber portions of a rough surface paper are printed on the printing side, whereas the lower, or more depressed portions and pores of the surface of this paper receive less color, or none at all. These flaws or imperfections, which become manifest as white or more faintly marked spots on the paper, are designated, in intaglio printing, as so-called "missing dots" by those skilled in this art. Accordingly, one does not receive the impression of an optically uniform dyed-in or colored surface. These differences in coloring agent layer thickness become quite apparent, particularly after saturation or impregnation of the paper with a synthetic resin solution and after pressing of such a paper onto a sheet or panel of wood material.

For the purpose of coloring or dyeing-in paper, a process has become known in the last few years in which a rotary wiper or squeegee of steel is pressed against a rubberized magnetic cylinder and the web of paper is guided over or across the magnetic cylinder. The rotary wiper or squeegee is supplied with coloring agent by way of a grooved roller or drum. Because of the rotary wiper or squeegee being pressed against and rolling off the paper, an elevated body or projection of coloring agent will be formed between the paper and the rotary wiper or squeegee, whereby the coloring agent is pressed onto and into the paper by means of the rotary wiper or squeegee. This coloring or dyeing system has become known in the art under the name of "Magnet-Roll-System" or magnetic roller system. Instead of the magnetic roller system, any other system in which a coloring agent is wiped or squeegeed into a web of paper is, of course, equally suitable theoretically. Thus, it would be also possible to employ, instead of the rotary wiper or squeegee being pressed against the paper by magnetic forces, for example, a doctor blade, but no satisfactory process exists at this time, particularly for papers having large widths, in which the contact pressure of the wiper or squeegee against the paper being guided over a roller or drum can take place sufficiently uniformly over the entire width of the roller or drum. It is for this reason that the magnetic roller system has been found to be satisfactory for a dyeing or coloring operation of this type. In the use of the magnetic roller system, it has been found that an effect is produced which is the opposite of the effect observed during the copper-plate intaglio printing and/or the flexo-relief or flexographic printing processes. In the magnetic roller system, a heavy application of the coloring agent layer will occur in the depressions and in the pores of the surface of a rough paper, whereas the elevations of the paper are less markedly dyed-in or colored. It is for this reason that, with the magnetic roller system alone, an optically uniform dyeing-in or coloring of rough surface paper is impossible.

It is an object of the present invention to provide for and propose a coloring process for absorptive, rough surface paper with a layer thickness of the coloring agent which is as thin as possible and yet having an optically uniform dyeing or coloring and which eliminates the disadvantages and drawbacks of the previously known printing and/or coloring systems while retaining the advantages thereof.

The optically uniform coloring or dyeing of a rough surface paper surprisingly succeeds by the present invention wherein the paper is printed on by copper-plate intaglio printing or flexo-relief or flexographic printing and, subsequently, but in any sequence desired, is colored or dyed-in by means of a magnetic roller system.

It is immaterial in the inventive process, which has been recited and defined herein, whether the paper is initially printed on by the copper-plate intaglio or rotogravure process and/or the flexo-relief or flexographic printing processes, and subsequently colored by means of a magnetic roller system, or whether the coloring is carried out first with the magnetic roller system and the paper is subsequently printed on in the manner described above.

The colored or dyed-in paper obtained in this manner has a thin layer thickness of coloring agent layer. However, it is so uniformly colored or dyed-in that optically, and particularly after the impregnation or saturation with synthetic resins and the pressing together of the semi-finished products obtained, no color flaws or imperfections are visible.

After the saturation or impregnation with synthetic resin solution and the pressing of the dyed-in or colored paper, as prepared by the present invention, the product cannot be distinguished from one using a paper which has been dyed-in or colored in the mass.

Even though the main field of application of the inventive process is in the printing-on and coloring of absorptive paper, the process may, of course, be used for paper which has only a limited absorptive capacity, or none at all, such as, paper used for wrapping photographic materials, which as a rule is dyed black on one side thereof.

The inventive printing and coloring system may be combined in a machine. But the systems may also be disposed separately from each other in two devices.

The inventive process will now be further described in conjunction with the accompanying drawing, hereinafter.

The roll of paper 1, which is to be colored or dyed-in or inked, is clamped into a roll-off or unwinding device and guided by way of reversing rollers 2 through the magnetic roller system A. The magnetic roller coloring system consists of the rubberized magnetic cylinder 3, the rotary wiper or squeegee 4, and the coloring or inking roller 5, which latter rotates in a tank 6 for the coloring agent. The rotary wiper or squeegee 4 is supplied with coloring agent by the grooved drum 5. Due to the rotary wiper or squeegee 4 being pressed onto the web of paper by magnetic forces and rolling off, an elevated body or projection of coloring agent will be produced between the paper and the rotary wiper or squeegee 4 at 7. The coloring agent is pressed by the rotary wiper or squeegee 4 onto and into the paper. After the coloring or dyeing by the magnetic roller system A, the web of paper runs or travels through an interposed drying device 8 and is guided by way of further reversing rollers 9 through the intaglio system B, which is equipped with a screen roller 10 for solid color printing. The screen roller 10 travels or operates in a tank 11 of the coloring agent, is squeegeed off by the wiper or squeegee 12, and the coloring agent is transmitted between the presser 13 and the screen roller 10 onto the web of paper. Thereafter, the now colored and printed-on web of paper is dried in a second drier 14, and the completely colored or dyed-in paper passes over reversing rollers 15 and is formed as a roll 16 by a roll-up or winding device.

It will be obvious to those skilled in the art that many modifications may be made within the scope of the present invention without departing from the spirit thereof, and the invention includes all such modifications.

What is claimed is:

1. A process for coloring a web of rough surface paper having elevated areas and depressed areas to produce a solid-color paper having a layer of a single, predetermined coloring agent thereon, as thin as possible and optically uniform over its entire surface, comprising coating said depressed areas by providing a magnetic coloring roller which is rotatable, attractable by a magnet, free to move in a direction perpendicular to the line of travel of said web and carries a film of said coloring agent and a magnet impression roller which is rotatable and fixed against movement in a direction perpendicular to said web, passing said web between said magnetic rollers and simultaneously drawing said magnetic roller against said web by the magnetic attraction of said magnet roller to deposit said coloring agent in said depressed areas of said web; and coating said elevated areas by providing a second coloring roller which is rotatable, is fixed against movement in a direction perpendicular to said web and carries a film of said coloring agent on a pattern of closely spaced, small areas having a height differing from the general surface thereof and a second impression roller which is rotatable and is fixed against movement in a direction perpendicular to said web and passing said web under pressure between said second coloring and impression rollers to deposit said coloring agent on said elevated portions of said web.

2. A process in accordance with claim 1 comprising providing a rotogravure printing plate on the second coloring roller carrying the film of coloring agent in a pattern of closely-spaced, depressed areas of said plate.

3. A process in accordance with claim 1 comprising providing a flexographic printing plate on the second coloring roller carrying the film of coloring agent on a pattern of closely-spaced, elevated areas of said plate.

4. A process in accordance with claim 1 wherein the web is passed between the magnetic and magnet rollers before it is passed between the second coloring and impression rollers.

5. A process in accordance with claim 1 wherein the web is passed between the magnetic and magnet rollers after it is passed between the second coloring and impression rollers.

6. A process in accordance with claim 1 wherein the web is dried between its passage between the magnetic and magnet rollers and its passage between the second coloring and impression rollers and is dried a second time after the last of said passages.

* * * * *

UNITED STATES PATENT AND TRADEMARK OFFICE

CERTIFICATE OF CORRECTION

PATENT NO. : 3,952,119

DATED : April 20, 1976

INVENTOR(S) : Helmut Bühler

It is certified that error appears in the above-identified patent and that said Letters Patent are hereby corrected as shown below:

Column 4, line 13 of Claim 1, after "magnetic" the words - - - and magnet - - - should appear.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*